US006783795B2

(12) United States Patent
Inoue et al.

(10) Patent No.: US 6,783,795 B2
(45) Date of Patent: Aug. 31, 2004

(54) POWER SUPPLY APPARATUS FOR DISCHARGE SURFACE TREATMENT

(75) Inventors: Tooru Inoue, Tokyo (JP); Akihiro Goto, Toyko (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/694,170

(22) Filed: Oct. 28, 2003

(65) Prior Publication Data

US 2004/0086657 A1 May 6, 2004

Related U.S. Application Data

(62) Division of application No. 09/660,417, filed on Sep. 12, 2000, now Pat. No. 6,702,896, which is a continuation of application No. PCT/JP98/02042, filed on May 8, 1998.

(51) Int. Cl.[7] ..... B05C 5/053

(52) U.S. Cl. ..... 427/8; 427/530; 427/540; 427/580; 118/638; 118/620; 323/208; 323/209; 320/166; 320/167; 219/69.19

(58) Field of Search ..... 118/620, 638; 427/8, 530, 540, 580, 59; 219/619.17, 619.18, 619.19; 323/208, 209, 210, 211, 277; 320/166, 167

(56) References Cited

U.S. PATENT DOCUMENTS 5,179,511 A 1/1993 Troyk et al.
5,240,584 A 8/1993 Szcyrbowski et al.
5,286,360 A 2/1994 Szcyrbowski et al.
6,020,723 A 2/2000 Desor et al.
6,086,684 A * 7/2000 Saito et al. ..... 148/220

FOREIGN PATENT DOCUMENTS

JP 54-153743 A 12/1979
JP 63-33580 A 2/1988
JP 6-247791 A 9/1994
JP 7-62521 A 3/1995
JP 7-197275 A 8/1995

* cited by examiner

*Primary Examiner*—Richard Crispino
*Assistant Examiner*—George R. Koch, III
(74) *Attorney, Agent, or Firm*—Sughrue Mion, PLLC

(57) ABSTRACT

In a power supply apparatus for discharge surface treatment which uses a green compact electrode as a discharge electrode, allows a pulse-type discharge to take place between said discharge electrode and a workpiece, and forms a film, which is made of an electrode material or a material obtained when the electrode material reacts to a discharge energy, on a surface of the workpiece following three measures are taken. (1) When a discharge voltage detected by the voltage detection means is less than or equal to discharge detection voltage set value which is slightly lower than a power supply voltage, the electric current cut-off means forcibly cuts off an output of the oscillator so that long-time pulse is prevented. (2) A capacitor is connected in parallel with an oscillation circuit of the oscillator, and the long-time pulse is prevented by capacitor discharge. (3) Time that the discharge takes place once is controlled by a timer so that the long-time pulse is prevented.

3 Claims, 6 Drawing Sheets

POWER SUPPLY APPARATUS FOR DISCHARGE SURFACE TREATMENT

This is a divisional of application Ser. No. 09/660,417 filed Sep. 12, 2000 now U.S. Pat. No. 6,702,896 B1, which is a Continuation of PCT/JP98/02042 filed May 8, 1998; the disclosures of which are incorporated herein by reference.

TECHNICAL FIELD

The present invention relates to a power supply apparatus for discharge surface treatment. More specifically, this invention relates to the power supply apparatus for discharge surface treatment which uses a green compact electrode as a discharge electrode, and allows a pulse-type discharge to take place between the discharge electrode and a workpiece so as to form a film, which film is made of an electrode material or a material obtained when the electrode material reacts to the discharge energy, on a surface of the workpiece.

BACKGROUND ART

FIG. 7 shows a prior discharge coating apparatus disclosed in Japanese Patent Application Laid-Open No. 54-153743. The discharge coating apparatus has a working tank 1 for housing working fluid, an electrode (covered electrode) 2 which is arranged so as to face a workpiece W in the working tank 1 with a predetermined discharge gap therebetween. A power supply apparatus (pulse power supply apparatus) 3 applies a pulse-like voltage to between the workpiece W and the electrode 2.

When the pulse-like voltage is applied to between the electrode 2 and the workpiece W, the discharge surface treatment by means of the discharge coating apparatus allows pulse-type discharge to take place between the electrode 2 and the workpiece W. As a result, a film made of the material of the electrode 2 or a material obtained when the material of the electrode reacts to the discharge energy is formed on the surface of the workpiece W.

The power supply apparatus 3 has a DC power supply 4, an oscillator 5 which generates a pulse current of a predetermined frequency by giving a DC current to the oscillator 5 from the DC power supply 4, electric current cut-off means 6 such as a thyristor, and voltage detection means 7 which detects a discharge voltage between the workpiece W and the working electrode 2.

A comparator 8 compares the discharge voltage detected by the voltage detection means 7 with a discharge detection voltage (threshold value Vth) set by a discharge detection voltage setting unit 9. The comparator 8 outputs a forced electric current cut-off command to the electric current cut-off means 6 after constant time At passes from the point of time that the discharge voltage (voltage detected value V) becomes lower than the set value Vth of the discharge detection voltage. The electric current cut-off means 6 forcibly ends the discharge according to the forced electric current cut-off command.

In the discharge coating apparatus having the above structure, the oscillator 5 applies a voltage to between the workpiece W and the electrode 2 that have a predetermined gap therebetween. When the gap between the workpiece W and the electrode 2 attains a predetermined value, discharge takes place between the workpiece W and the electrode 2. The workpiece W is worked by the discharge energy.

When the discharge starts, the inter-electrode voltage abruptly drops at the point of time shown by a point A in FIG. 8. The voltage detection means 7 detects such a drop in the voltage, and after the constant time At passes from the starting of the discharge, the electric current cut-off means 6 cuts off the output of the oscillator 5 so that the discharge is forcibly terminated. After the discharge current completely fails, voltage is again applied to between the workpiece W and the electrode 2 by the output of the oscillator 5.

As a result, long-time pulse is not obtained, and the voltage is cut off at suitable discharge time. Therefore, occurrence of a layer having different properties on the surface of the workpiece is avoided, and a satisfactorily worked surface can be obtained.

At the time of the discharge working, since discharge tailing which generates between the workpiece W and the electrode 2 during the working floats, and thus the resistance between the electrodes is lowered. As a result, the inter-electrode voltage at the time of discharge is also lowered. For this reason, when the set value Vth of the discharge detection voltage is set to a higher value, it is difficult to detect the discharge normally. Therefore, the set value Vth of the discharge detection voltage should be set to a comparatively low value as shown in FIG. 8.

When a green compact electrode obtained by compression-molding metallic powder or metallic compound into an electrode shape is used in the discharge surface treatment, the electrical resistance of the electrode is considerably higher than that of a normal copper electrode. As shown in FIG. 7, the voltage detection means 7 which is connected with a circuit reads also a part of the voltage which drops because of the electrical resistance of the working electrode 2. The characteristic of the voltage detected by the voltage detection means 7 is as shown in FIG. 9, and the detected voltage does not drop sufficiently even after the discharge has terminated so that the discharge cannot be detected.

As a result, the output of the oscillator cannot be cut off suitably, and the discharge with long-time pulse is generated so that it is difficult to maintain the suitable discharge state.

The present invention is devised in order to solve the above problems, and it is an object of the invention to provide a power supply apparatus which cuts off a voltage at suitable discharge time and prevents long-time pulse discharge in a discharge surface treatment using a green compact electrode.

DISCLOSURE OF THE INVENTION

The present invention can provide a power supply apparatus for discharge surface treatment which uses a green compact electrode as a discharge electrode, allows pulse-type discharge to take place between the discharge electrode and a workpiece, and forms a film, which is made of an electrode material or a material obtained when the electrode material reacts to the discharge energy, on a surface of the workpiece, including: an oscillator which generates a pulse current of a predetermined frequency when an electric current from a power source is applied thereto; electric current cut-off means which cuts off an output of the oscillator; and voltage detection means which detects a discharge voltage between the workpiece and a working electrode, wherein when the discharge voltage detected by the voltage detection means obtains not more than discharge detection voltage set value, the electric current cut-off means forcibly cuts off the output of the oscillator, and the discharge detection voltage set value is set to a value slightly lower than a power-supply voltage.

Therefore, in the discharge surface treatment using the green compact electrode, a voltage is cut off at suitable discharge time so that long-time pulse discharge is prevented.

In addition, the present invention can provide power supply apparatus for discharge surface treatment which uses a green compact electrode as a discharge electrode, allows pulse-type discharge to take place between the discharge electrode and a workpiece, and forms a film, which is made of an electrode material or a material obtained when the electrode material reacts to the discharge energy, on a surface of the workpiece, characterized by including: an oscillator which generates a pulse current of a predetermined frequency when an electric current is given from a power supply thereto, wherein a capacitor is connected with an oscillation circuit of the oscillator in parallel.

Therefore, in the discharge surface treatment using the green compact electrode, the discharge is ended with capacitor discharge which is determined by capacitance of the capacitor, and long-time pulse discharge is prevented in the discharge surface treatment using the green compact electrode.

Further, the present invention can provide a power supply apparatus for discharge surface treatment, wherein a reactance is connected with the oscillation circuit in a series.

Therefore, the discharge current can be distorted, the discharge current can be controlled so as to have the suitable waveform for the discharge surface treatment.

Further, the present invention can provide a power supply apparatus for discharge surface treatment which uses a green compact electrode as a discharge electrode, allows pulse-type discharge to take place between the discharge electrode and a workpiece, and forms a film, which is made of an electrode material or a material obtained when the electrode material reacts to the discharge energy, on a surface of the workpiece, including: an oscillator which generates a pulse current of a predetermined frequency when an electric current is given from a power supply thereto; electric current cut-off means which cuts off an output of the oscillator; and timer means, wherein the electric current cut-off means forcibly cuts off the output of the oscillator per constant time which is counted by the timer means.

Thus, the duration of time for which the discharge takes place once is controlled by the timer. Therefore, long-time pulse discharge is prevented in the discharge surface treatment using the green compact electrode.

BRIEF DESCRIPTION OF DRAWINGS

FIG. 4(*b*) is a graph showing an inter-electrode current characteristic in the second embodiment;

BEST MODE FOR CARRYING OUT THE INVENTION

There will be explained below preferred embodiments of the present invention with reference to the attached drawings. In the preferred embodiments of the present invention explained below, same legends have been provided to parts of a structure which are the same as those of the prior structure, and the explanation thereof is omitted.

First Embodiment

Figure 1:
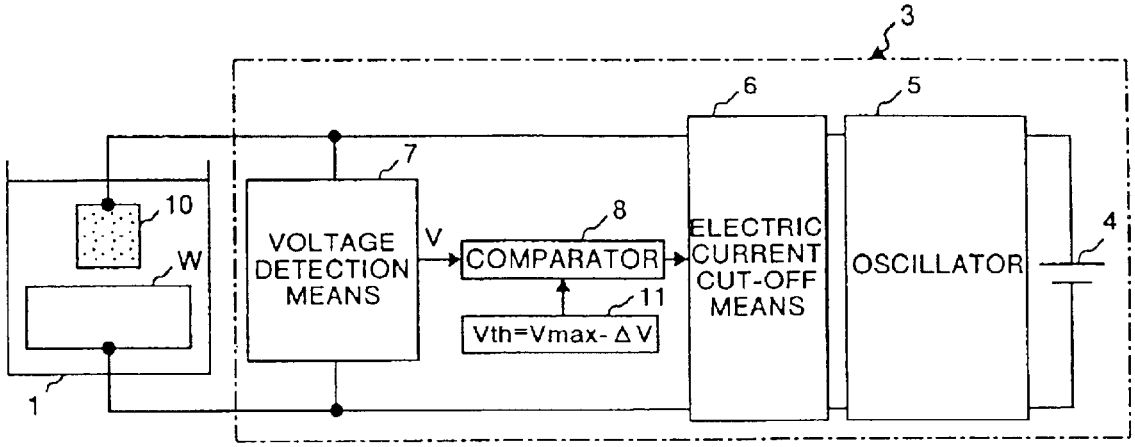
FIG. 1 is a block diagram showing a power supply apparatus for discharge surface treatment according to a first embodiment of the present invention.

FIG. 1 shows a power supply apparatus for discharge surface treatment of the present invention.

The discharge electrode (electrode for machining) 10 is a green compact electrode which is obtained by compression-molding metallic powder or metallic compound into an electrode shape.

Figure 2:
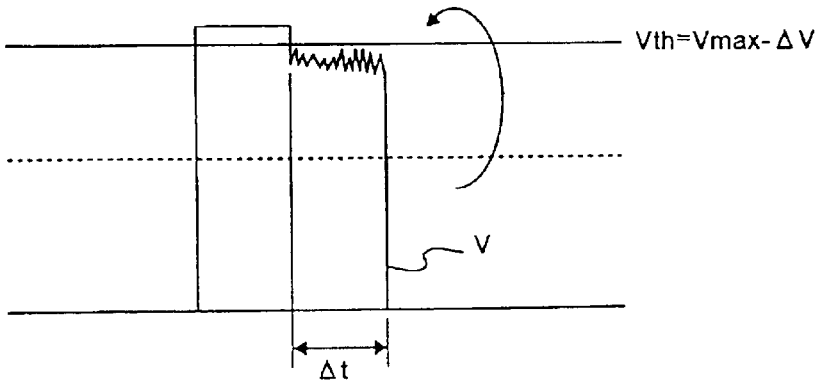
FIG. 2 is a graph showing interelectrode voltage characteristic and a discharge detection voltage set value in the first embodiment.

The discharge detection voltage set unit 11 sets, as shown in FIG. 2, a discharge detection voltage set value Vth to a value Vmax−ΔV which is slightly lower than a discharge supply voltage Vmax. Here, ΔV is about 5 to 20% of Vmax.

In this power supply apparatus 3, when a discharge voltage V which detected by the voltage detection means 7 is less than or equal to the discharge detection voltage set value Vth which is equal to Vmax−ΔV, that is a value which is slightly lower than the power-supply voltage Vmax, then the output of the oscillator 5 is forcibly cut off by the electric current cut-off means 6 after elapse of a predetermined time Δt.

As a result, in the discharge surface treatment using the green compact electrode, the voltage is cut off at suitable discharge time, and long-time pulse discharge is prevented.

In the discharge surface treatment, since discharge tailing is not generated between the electrodes, a voltage in a no-load state does not drop. For this reason, when the discharge detection voltage is set to a value slightly lower than the power-supply voltage, the discharge can be detected normally even if the voltage value during the discharge is high.

Second Embodiment

Figure 3:
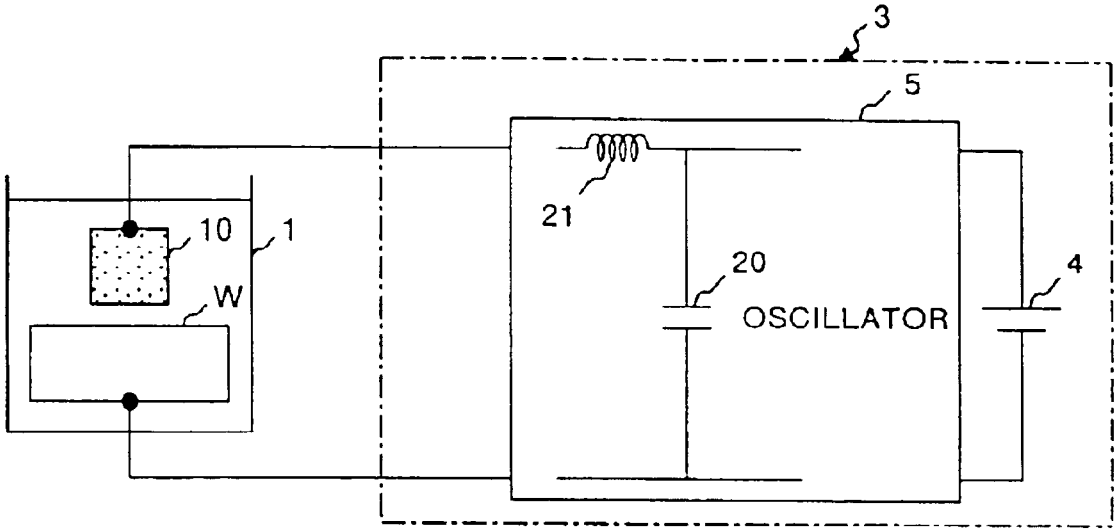
FIG. 3 is a block diagram showing the power supply apparatus for discharge surface treatment according to a second embodiment of the present invention.

FIG. 3 shows the power supply apparatus for discharge surface treatment of the present invention.

A capacitor 20 is connected with an oscillation circuit of the oscillator 5 in parallel, and a reactance 21 is connected with the oscillation circuit in a series.

The oscillation circuit of the oscillator 5 applies a voltage to between the discharge electrode 10 and the workpiece W. The discharge electrode 10 is a green compact electrode. Accordingly, parallel and series connection with this oscillation circuit is equivalent to that when the oscillation circuit is connected with the discharge electrode 10 and the workpiece W in parallel and in series.

An electric charge is stored in the capacitor 20 of the oscillator 5. When the amount of the electric charge stored in the capacitor 20 exceeds a specific amount, discharge takes place between the discharge electrode 10 and the workpiece W so that an electric current flows. When the electric current flows, the electric charge in the capacitor 20 is reduced and the discharge terminates.

Figure 4:
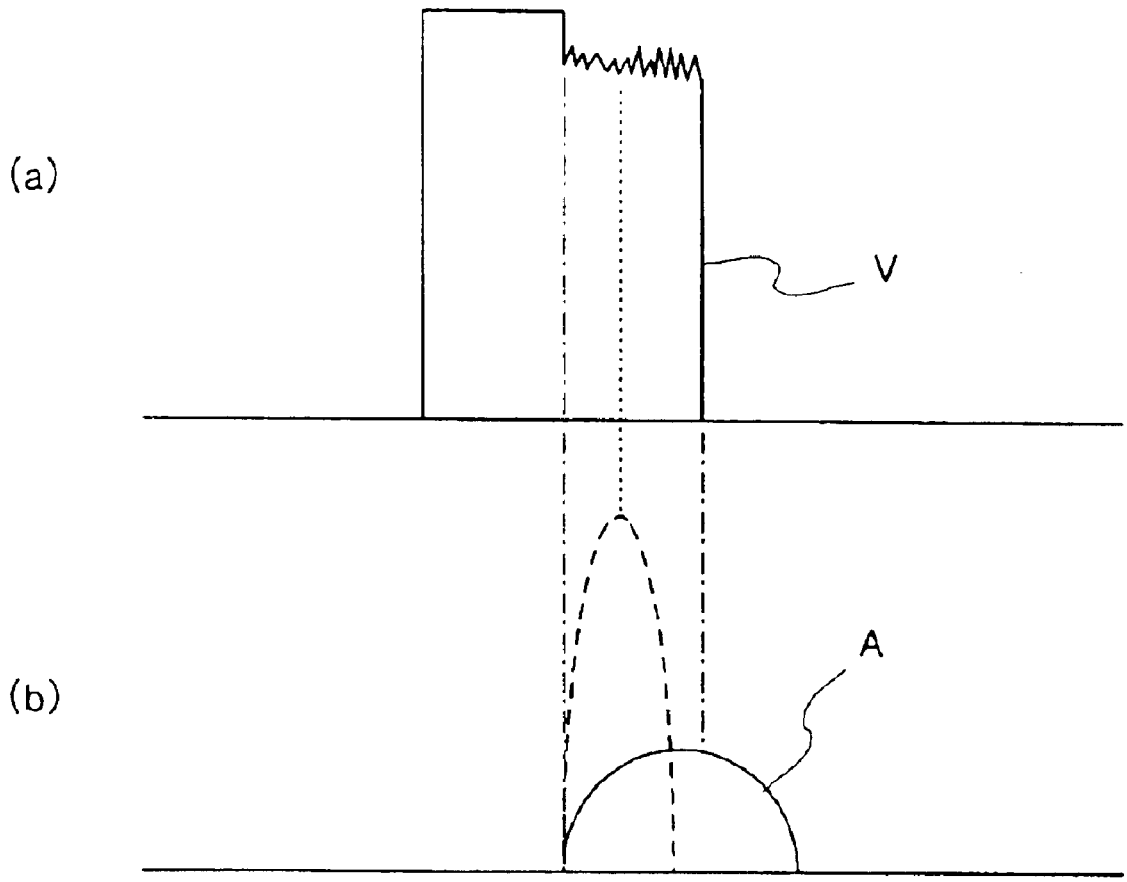
FIG. 4(*a*) is a graph showing an inter-electrode voltage characteristic in the second embodiment.

As a result, even if the discharge voltage is not detected, the normal discharge state with the inter-electrode voltage characteristic can be realized as shown in FIG. 4(*a*).

That is, the discharge terminates along with the capacitor discharge which depends upon the capacitance of the capacitor, and long-time pulse discharge is prevented in the discharge surface treatment using the green compact electrode.

However, as shown by a dotted line in FIG. 4(*b*), only with the capacitor 20, there is a possibility that the discharge current attains a high peak and ends in a short time. Therefore, sometimes a suitable electric current waveform cannot be obtained in the discharge surface treatment.

On the contrary, when the reactance 21 is inserted in a series, as shown by a solid line in FIG. 4(*b*), the discharge current can be distorted. For this reason, the value of the capacitor 20 and the value of the reactance 21 are adjusted together so that the discharge current can be adjusted so as to have a suitable waveform for the discharge surface treatment. As a result, the suitable treated surface can be obtained.

The reactance 21 may be replaced by an internal reactance included in the circuit, and the capacitor 20 and the reactance 21 can be of changeable type.

Third Embodiment

Figure 5:
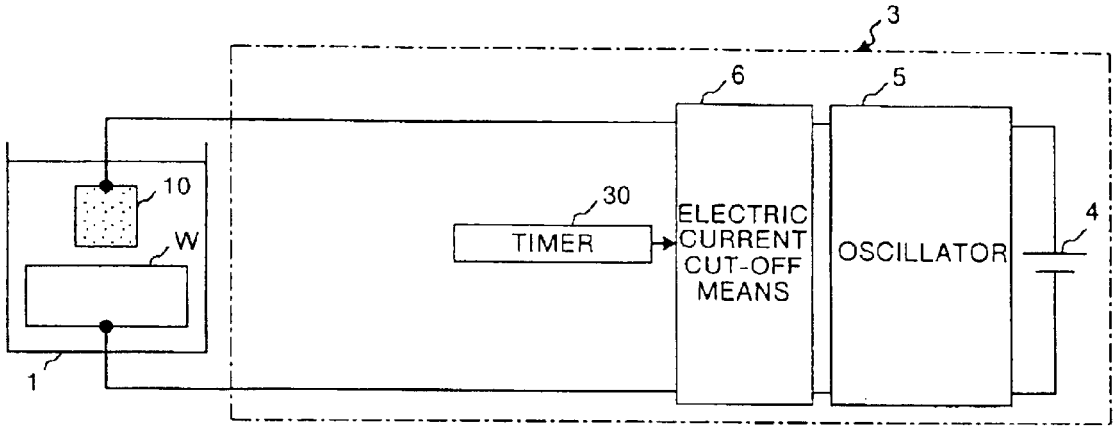
FIG. 5 is a block diagram showing the power supply apparatus for discharge surface treatment according to a third embodiment of the present invention.

FIG. 5 shows the power supply apparatus for discharge surface treatment of the present invention.

This power supply apparatus is provided with a timer means 30. This timer means 30 counts elapse of a specific time Tcon. The electric current cut-off means 6 forcibly cuts off the output of the oscillator 5 every time the timer means 30 counts that the time Tcon has elapsed.

Figure 6:
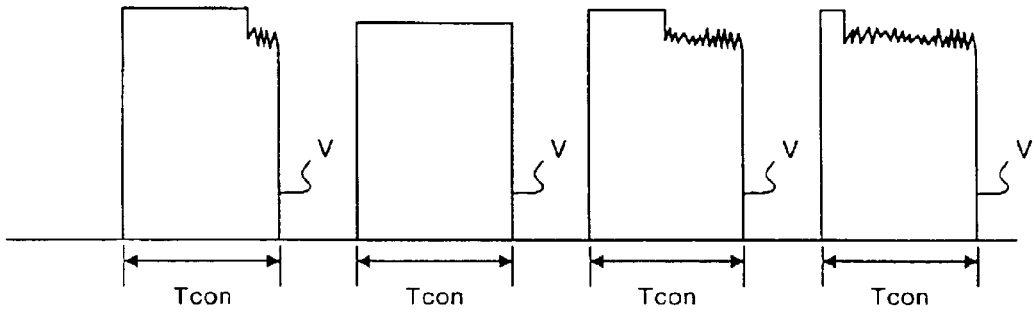
FIG. 6 is a graph showing the inter-electrode voltage characteristic in the third embodiment.
Figure 7:
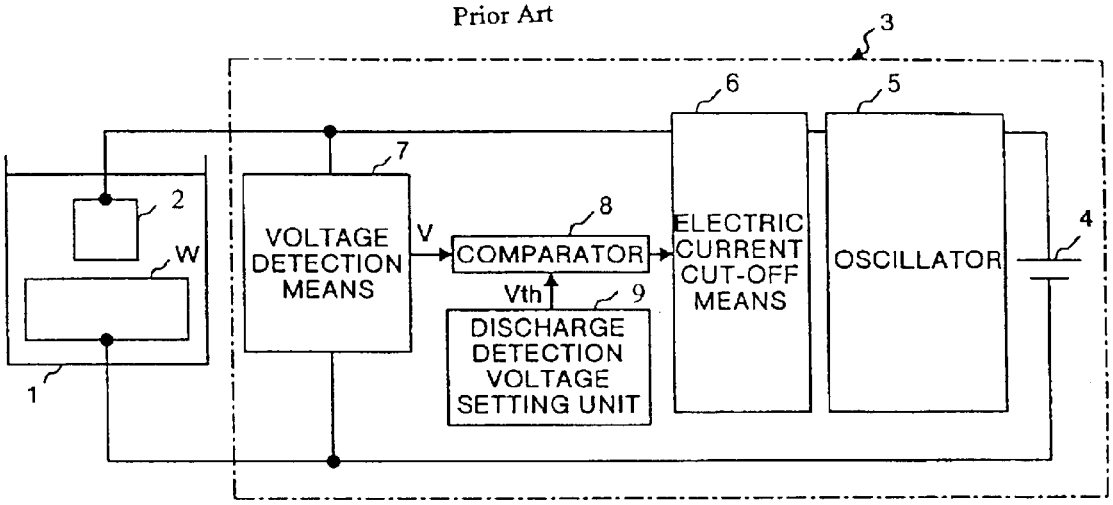
FIG.7 Prior Art
FIG. 7 is a block diagram showing a conventional discharge coating apparatus.
Figure 8:
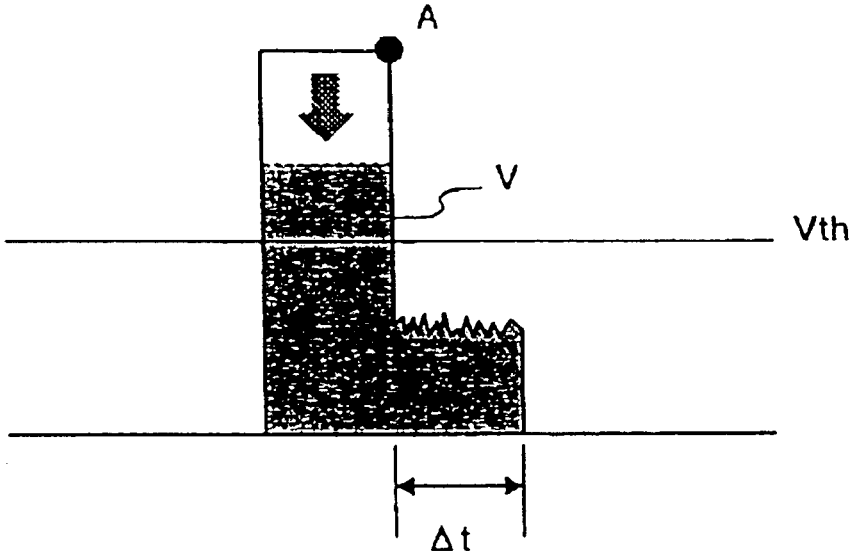
FIG.8 Prior Art
FIG. 8 is a graph showing inter-electrode voltage characteristic and a discharge detection voltage set value in the prior discharge coating apparatus.
Figure 9:
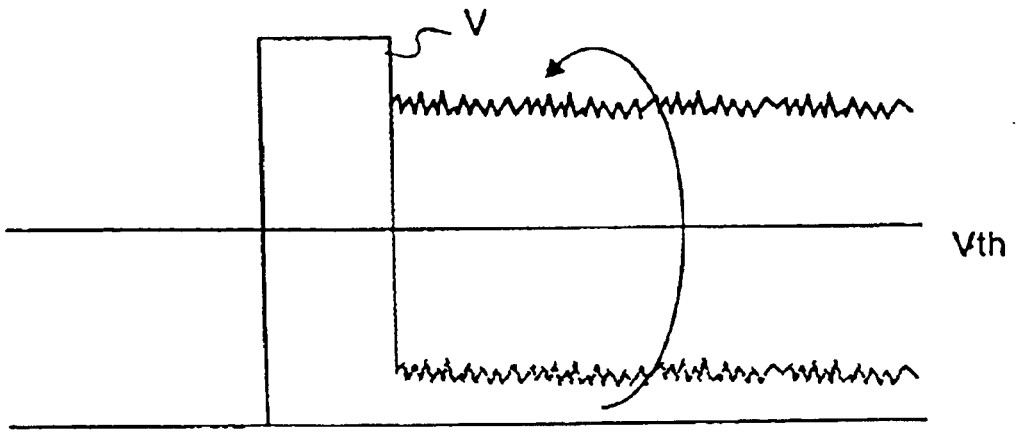
FIG.9 Prior Art
FIG. 9 is a graph showing the inter-electrode voltage characteristic and the discharge detection voltage set value in the case where a green compact electrode is used.

In this embodiment, as shown in FIG. 6, the applied voltage is cut off per constant time Tcon regardless of a discharge state, and long-time pulse can be prevented in the discharge surface treatment using the green compact electrode without detecting a discharge voltage.

INDUSTRIAL APPLICABILITY

As mentioned above, the power supply apparatus for discharge surface treatment of the present invention realizes the prevention of long-time pulse in the discharge surface treatment using the green compact electrode, and can be utilized as a power supply apparatus of a discharge coating apparatus which uses the green compact electrode.

What is claimed is:

1. A discharge surface treatment method, comprising the steps of:

placing a green compact electrode, formed of compressed powder as a discharge electrode, adjacent to a workpiece;

generating a pulse current when an electric current from a power source is applied to an oscillator;

creating a pulse-type discharge between the discharge electrode and the workpiece, to form on a surface of the workpiece a film made of an electrode material or of a material obtained when the electrode material reacts to the discharge energy;

cutting off the output of the oscillator;

detecting a discharge voltage between the electrode and the workpiece; and forcibly cutting off the output of the oscillator when a predetermined period of time has passed after detecting the discharge voltage to be less than or equal to the discharge detection voltage set value, wherein the discharge detection voltage set value is set at a value about 5 to 20% lower than a power-supply voltage.

2. A discharge surface treatment method, comprising the steps of:

placing a green compact electrode, formed of compressed powder as a discharge electrode, adjacent to a workpiece;

generating a pulse current of a predetermined frequency when an electric current from a power source is applied to an oscillator; and creating a pulse-type discharge between the discharge electrode and the workpiece, to form on a surface of the workpiece a film made of an electrode material or of a material obtained when the electrode material reacts to the discharge energy, wherein a capacitor is connected in parallel with an oscillation circuit of the oscillator.

3. The discharge surface treatment method according to claim 2, wherein a reactance is connected in series with the oscillation circuit.

* * * * *